US007147556B1

(12) United States Patent
Harpaz

(10) Patent No.: US 7,147,556 B1
(45) **Date of Patent: *Dec. 12, 2006**

(54) GAMES GRID BOARD

(76) Inventor: Yehouda Harpaz, 129 Corrie Road, Cambridge, Cambs (GB) CB1 3QQ ( * ) Notice: Subject to any disclaimer, the term of this patent is extended or adjusted under 35 U.S.C. 154(b) by 688 days.

This patent is subject to a terminal disclaimer.

(21) Appl. No.: 10/031,942

(22) PCT Filed: Jul. 17, 2000

(86) PCT No.: PCT/GB00/02746

§ 371 (c)(1),
(2), (4) Date: Jan. 23, 2002

(87) PCT Pub. No.: WO01/14027

PCT Pub. Date: Mar. 1, 2001

(30) Foreign Application Priority Data

Aug. 19, 1999 (GB) ..... 9919551.3
Feb. 8, 2000 (GB) ..... 0002705.2

(51) Int. Cl.
*A63F 13/00* (2006.01)

(52) U.S. Cl. ..... 463/9

(58) Field of Classification Search ..... 463/9; 273/236, 237, 271, 284, 460, 454, 455
See application file for complete search history.

(56) References Cited

U.S. PATENT DOCUMENTS 3,753,562 A * 8/1973 Knowlton ..... 273/267
4,244,635 A * 1/1981 Sasaki et al. ..... 349/1
4,359,220 A * 11/1982 Morrison et al. ..... 463/9
4,364,568 A * 12/1982 Tracy ..... 273/242
4,436,309 A * 3/1984 Barlow et al. ..... 273/267
4,492,581 A * 1/1985 Arai et al. ..... 434/128
4,513,973 A * 4/1985 Sinclair ..... 273/237
4,809,979 A * 3/1989 Skowronski et al. ..... 463/9
5,286,037 A * 2/1994 Ghaly ..... 463/9
5,417,425 A * 5/1995 Blumberg et al. ..... 273/153 R
5,573,245 A * 11/1996 Weiner et al. ..... 273/153 R
5,603,500 A * 2/1997 Olti et al. ..... 273/153 R
5,743,796 A * 4/1998 Orak et al. ..... 463/9
5,803,458 A * 9/1998 Snyder ..... 273/273
5,961,118 A * 10/1999 Chie et al. ..... 273/264
6,186,505 B1 * 2/2001 Perrie et al. ..... 273/274
6,231,441 B1 * 5/2001 Golad ..... 463/9
6,250,633 B1 * 6/2001 Mohtasham et al. ..... 273/261

(Continued)

FOREIGN PATENT DOCUMENTS

EP 0 403 130 * 12/1990

(Continued)

OTHER PUBLICATIONS

OS2World, lites Out!, Jan. 1997, taken from Internet, http://www.os2world.com/games/html/lites_out_.html.*

(Continued)

*Primary Examiner*—John M. Hotaling, II

(57) ABSTRACT

A board is made of many grid points (1 and 2) arranged in a grid on a flat surface (6), and connected to a game manager (3) (a CPU+memory+software). Each grid point notifies the games manager when it is pressed, and the games manager can illuminate each grid point by one of two colors. The boards play a game in which the game starts with an equal number of points illuminated in each of the two colors. Each player in their turn presses a point, and in response the games manager switches of some points (possibly none) and potentially changes the color of some other points. When all the points that are illuminated are illuminated in the same color, the player of this color wins.

2 Claims, 5 Drawing Sheets

U.S. PATENT DOCUMENTS 6,276,687 B1 * 8/2001 Lenhart ..... 273/267
6,568,683 B1 * 5/2003 Harpaz ..... 273/460

FOREIGN PATENT DOCUMENTS

GB 2019226 * 10/1979
WO WO 97/26057 * 7/1997
WO WO 98/19758 * 5/1998

OTHER PUBLICATIONS

Internet Archive, Othello Feb. 1999, http://web.archive.org/web/1999021053422/http://memebers.aol.com/shadows125/othello.*
British Othello Federation, Rules of Othello, circa 1998, http:/www.britishothello.org.uk/bof4.html.*

* cited by examiner

GAMES GRID BOARD

This invention relates to board games in which a move is done by indicating a point on the board, and the state of the game is expressed in the state of the points. These include traditional games like Go, but also large number of other potential games, puzzles and exercises. The invention presents an electronic board to play these games, and a new kind of game to play on it.

Games like Go are played by each player, in his turn, adding a pebble to the board, on one of the points in a grid of lines drawn on the board, or in one of the squares on the board. These games have the advantages of being based on simple playing acts and being interesting intellectually. Their disadvantages are:

1) They require somewhat tricky movement when putting the stone on the board in the right place without disturbing other stones.

2) They tend to suffer from delays when a player is thinking on a move.

3) Some of the moves require additional 'housekeeping' operations, e.g. taking stones of the board in Go.

4) The players need to keep the rules and do the counting of stones themselves, which puts extra demand on the players.

5) The stones are separate objects, which are easily lost.

6) It is difficult to play games which require starting the game with many points occupied, for example the game that is described below.

Disadvantages 3–6 can be solved by programming a computer to display the board and stones. The program would be simple enough that it can be put on a small and cheap CPU, and hence be built into a standalone playing board. In principle, the computer could also limit the time allocated to each player, thus solving disadvantage 2.

The problem of input (disadvantage 1), however, is not solved so well by current electronic systems. That is because input for existing electronic systems is normally done through buttons, or other devices, which are separated from the display. For games where there is a small repertoire of possible different inputs this is acceptable, but for board games there are many possible different inputs (the number of points in the grid). Inputting a point on buttons off the display requires the players to perform some mental operation to convert the point they think about to the right input. This is relatively slow and error-prone process. For slow-going games that is very annoying but may be acceptable, but it makes it impossible to play fast on these systems, and for most people this is a decisive factor.

This disadvantage can be overcome by a making a board in which the input and the display are together, and these kind of boards started to appear, at least as patent applications. However, the range of the games that can be played on these board is still limited. The current invention describes such a simple board and a novel games with many interesting variations which can be played on it.

The conceptual structure of the hardware of the board is sketched in FIG. 1.

According to the current invention the user accessible part of the board is made of grid points 1 & 2 which are arranged in a grid on a flat surface 6. Each grid point is a clearly visible element 1 which can detect when it is pressed, and can be illuminated in at least two colours by an illumination source 2 in or below the surface. The figure shows only 3 grid points for clarity, but the actual board has many more grid points (typically 36–1000). The figure also shows the illumination source 2 separately from the visible part of the grid point 1, which denotes the fact that pressing a grid point does not affect its illumination. All the grid points are connected to a games manager 3, which is a CPU+memory+software. When a grid point is pressed, the games manager 3 is notified (arrows from the visible part 1 to the games manager 3), and the games manager 3 controls which sources of illumination are on (arrows from the games manager 3 to the sources of illumination 2). The games manager is programmed to manage various games. Managing a game means that the board displays the state of the game by putting on the appropriate sources of illumination 2. When a sensor 1 is pressed, the games manager computes the implication according the rules of the current game, and changes some of the sources of illumination 2 (possibly none) to reflect the new state of the game. The board may also change which sources of illumination are on when no point is pressed. This board can be used to implement many games.

According to the current invention, some of these games are variations of the novel game ClearIt. The basic rules of ClearIt are:

The game starts with many grid points illuminated. Each player in their turn press a point, and in response the games manager switches some points off and change the colour of some other points according to some rule. When all the points that are illuminated are illuminated in the same colour, the player of this colour wins.

To allow the users to utilise all the functionality of the board, it will need a control area 4, which allows the players to change the current game, change the rules of the current game and change other parameters, like the length of time that each player has to perform his move. The control area 4 also displays the current score of the game. Typically, the control area will contain few control buttons and an alphanumeric display. The games manager receives information from the control area about which control buttons were pressed, and controls what is displayed in the alphanumeric display.

The basic functionality of the games manager comprises these actions:

1) When the users indicate through the control area 4 that they want to change the current game or any of the parameters of the current game, the game manager sets its own internal state to the new value, and indicates to the users the new value.

2) When one of the grid points is pressed and the current game and parameters make it illegal for the current player to press some of the points, the games manager checks if the pressed point is allowed according to the rules and parameters of the current game and the current state of the game (i.e. which points are illuminated). If the pressed point is not allowed, the games board may issue some indication that an illegal point was pressed, may indicate why it is not allowed by some message through the control area 4, and may indicate which points are allowed (e.g. by flashing them). Note that illuminated points, while typically are not allowed, may be allowed in some games.

3) When a point is pressed and it is allowed according to the current rules, parameters and state of the game, the games manager computes the implications and then changes the illumination of some (possibly zero) points to reflect the new state of the game. Note that:

a) While typically the point that is pressed changes its illumination, this is not mandatory.

b) Other points except the pressed point may change as well.

4) If the rules of the current game require it, the games manager changes the illumination of some points even when none of the points is pressed, typically once each some time period (or 'generation').

5) After each change to the illumination of any grid point, the games manager computes the current score and displays it using the control area 4.

6) After each change to the illumination of any grid point, the games manager checks, using a game-specific routine, if the game is finished. If the game is finished, the games manager indicates it, typically by some message in the control area 4, and maybe other additional signals.

The board will also need a way to signal whose turn it is, which would typically be done by two turn lights 5, which are in two separate colours, corresponding to two of the colours of the illumination in the grid points. The games manager controls these turn lights, and signal to the players whose turn it is by switching the corresponding turn light.

The arrangement of the grid points would be in most cases square as in FIGS. 3 and 4, but can also be of different shapes (e.g. rectangular, hexagonal (as shown in FIG. 5), triangular or less regular). The overall shape of the board would typically be square, but can also vary, e.g. a jagged-edge rectangle as in FIG. 5.

The kind of games that the board will be programmed to play include (but not restricted to):

1) Traditional two-person games like Go, where each player is associated with one colour.

2) Novel two-person games like the one described in this invention.

3) Puzzles and single-player games.

4) Fluid games, which means games where the patterns of illuminated points changes even when the player(s) don't press any point.

5) Memory games.

In each game, there can be many possible variations. In the case of ClearIt, these include:

1. Initial pattern of illuminated. Typically the number of points illuminated will be around half of the total number of points, but this would be under the control of one of the settable parameters, and gives interesting games in the range of ¼ to ¾ of the total number. The arrangement of illumination will typically vary randomly between games.
2. Whether the players can press only unilluminated points, only illuminated points or both. Allowing pressing only unilluminated seems to give the most interesting game
3. The most interesting variations are in the rule that defines which points are affected after each point-press. This rule would typically be a combination of two basic rules:
   a. Which of the points that are illuminated in the colour of the opponent of the current player are switched off when the current player presses a point.
   b. Which of the points that are illuminated in the colour of the current player are switched off. This rule make the game more interesting, because the players need to take into account the number of their points that they are going to lose when they play any specific point.

Each of these two rules specifies a pattern of points with respect to the point that the player presses which are affected. Few examples are give in FIG. 4, in which the circles represent grid points. Each group of a black square and surrounding pluses represents a pattern, where the black square is the point that the player pressed, and the pluses are the points that are affected.

As the pattern 18 shows, the pattern does not have to be symmetrical, but symmetrical patterns are preferred because they are easier to memorise. The patterns can range in complexity from very simple, as in 15, to moderately complex, as in patterns 17–19 to much more complex ones. The latter may simply include more points or more distant points but can also include various transformations. For example a simple pattern combined with rotation of the board by 90 degrees, so pressing a point in the top-left corner of the board will affect points in the top-right corner of the board.

However, the patterns in FIG. 4 seems to be already complex enough to create very interesting games. From experiments, the best combination seems to be pattern 17 for the opponent's colour, and pattern 19 for the player's colour. In other words, when a player presses a point, each point which is illuminated in the opponent's colour and can be reached from the pressed point by moving two points vertically or horizontally and then moving one point in an orthogonal direction is switched off, and the same for every point of the player's colour which can be reached by moving three points horizontally or vertically and then moving two points in an orthogonal direction.

FIG. 5 shows few examples of possible patterns on a board where the arrangement of the points is hexagonal rather than square.

4. Additional variation to the game is to change one of basic rules so that affected points change their colour to the other colour, rather than being switched off. Only one of the basic rules can be changed, because if both are changed no points are switched off, so the game will go on forever. These variations give more complex games with much more strategic 'depth'. When the rule that changed is that points of the opponent's colour change their colour rather than being removed, an added rule that make it illegal to play a point that does not switch off any point is required, otherwise a player can always switch some of the opponent's points to his colour, and the game will never end.

A specific embodiment of the invention will now be described with reference to the accompanying drawings.

Figure 1:
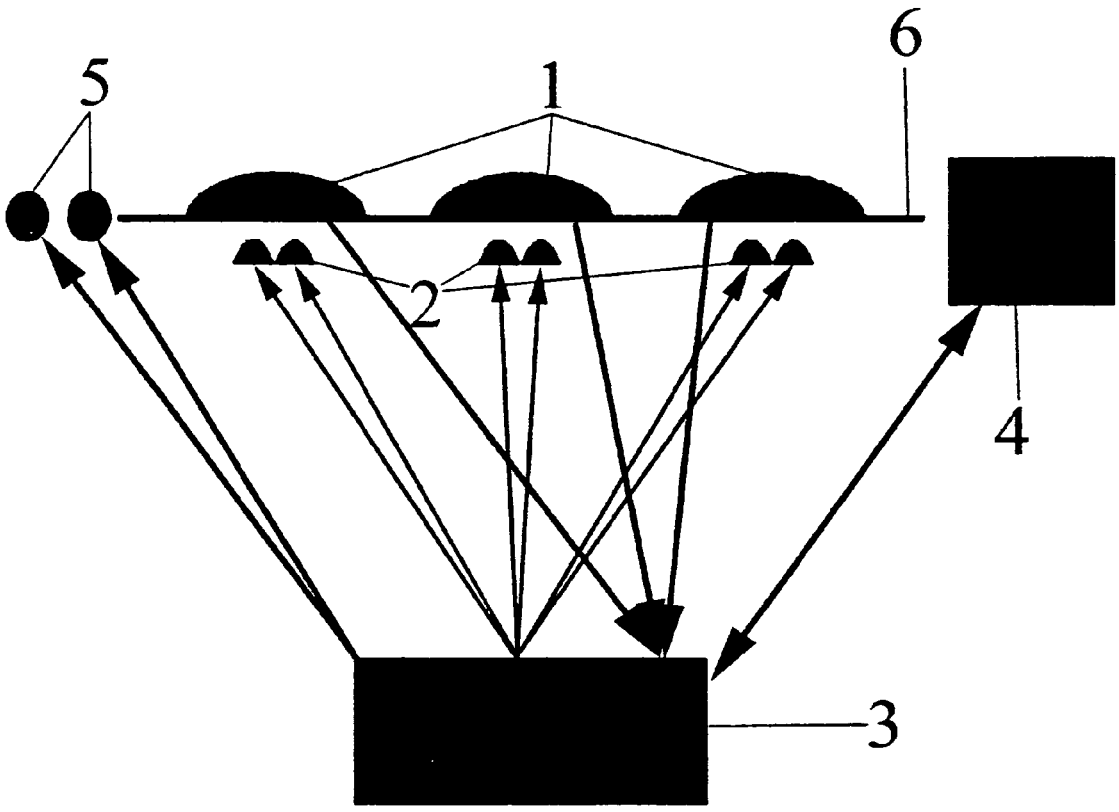
FIG. 1 shows the conceptual structure of the board.
Figure 2:
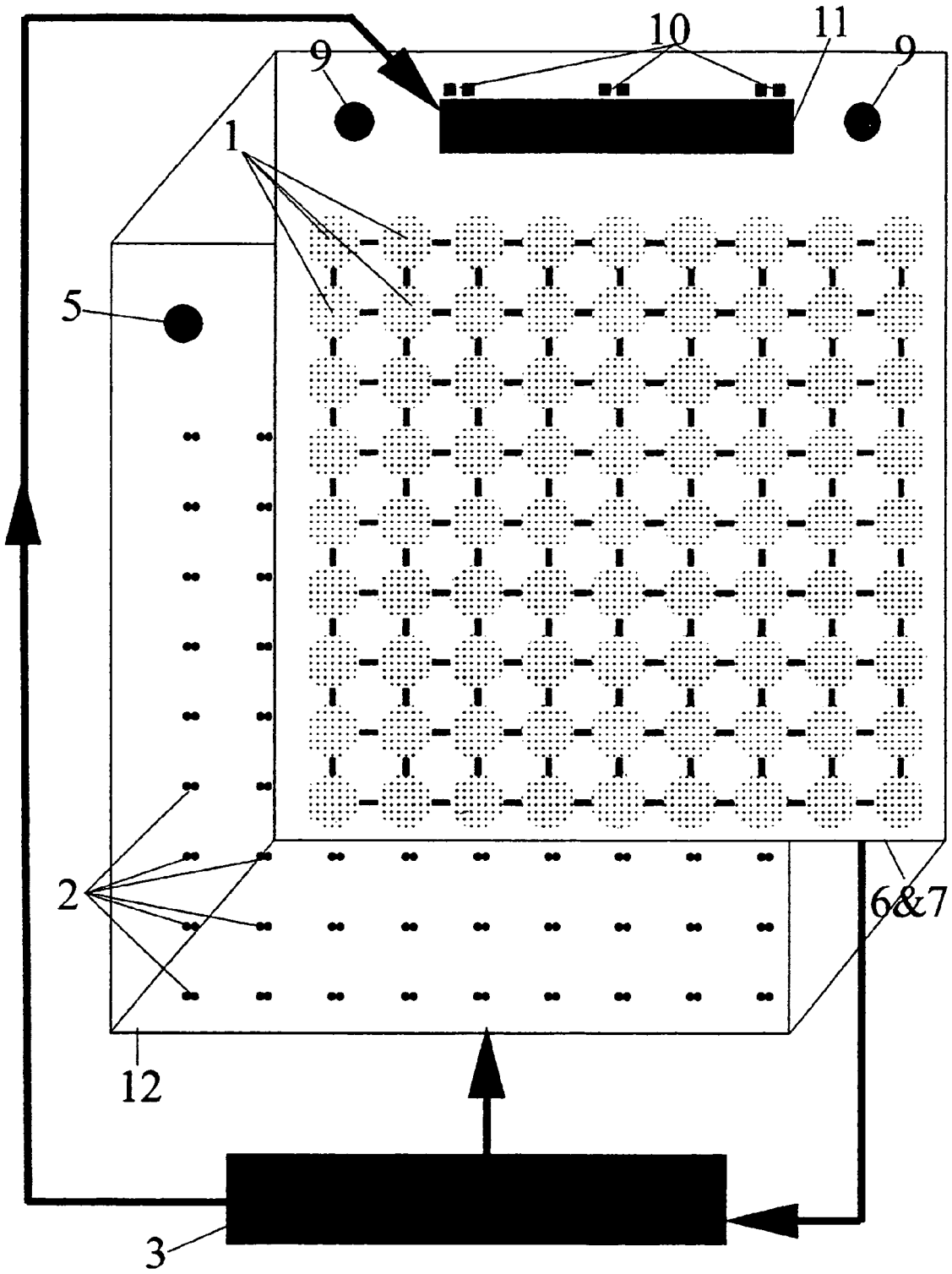
FIG. 2 shows a sketch of the electronic components of an example board.

The inputs of grid points 1 are implemented by a custom-design membrane keyboard 7 on a PCB 6, which together comprise the top of a flat rectangular box. The membrane keyboard contains a grid of 9×9 translucent buttons 1, which are in a shape of small domes. Between the buttons the membrane is painted with lines 8 drawn on the imaginary lines connecting the centres of the buttons. The PCB 6 has holes below each button, with additional holes 9 for the turn lights. Both the PCB 6 and the membrane keyboard 7 has a hole for the alphanumeric display 11.

The illumination of the grid points is implemented by 9×9 pairs of LEDs 2 mounted on a PCB 12, which is itself mounted below the membrane keyboard such that each LEDs pair 2 is under the centre of one of the buttons 1. In each pair one LED is of one colour (e.g. green) and the other of another colour (e.g. red). Alternatively, each LEDs pair can be replaced by a bi-colour LED. The two turn lights 5 are implemented by two large LEDs, one in one of the colours of the pairs of LEDs 2, and one in the other colour, mounted on PCB 12 as the rest of the LEDs. The electronic circuitry to drive the LEDs 2 and the turn lights 5 is also on PCB 12.

The membrane keyboard 7 also contains several control buttons 10, which allow the users to control the game (start, stop etc.) and to select which game is played and set parameters for the current game. An alphanumeric display 11 is mounted in a hole in the membrane keyboard 7. The control buttons 10 and the display 11 together comprise the control area 4 of FIG. 1.

All the input from the membrane keyboard goes to the games manager 3, which is a small CPU (around 5MIPS) and a little ROM and RAM (around 32 Kb and 6 Kb respectively). The games manager 3 is placed below the LEDs PCB 12. A custom design electronic circuitry (denoted by arrows from the membrane keyboard 7 to the games manager 3, and from the games manager 3 to the PCB 12 and to the display 11) allows the games manager 3 to switch on and off each individual LEDs, and to display the appropriate information in the alphanumeric display.

Figure 3:
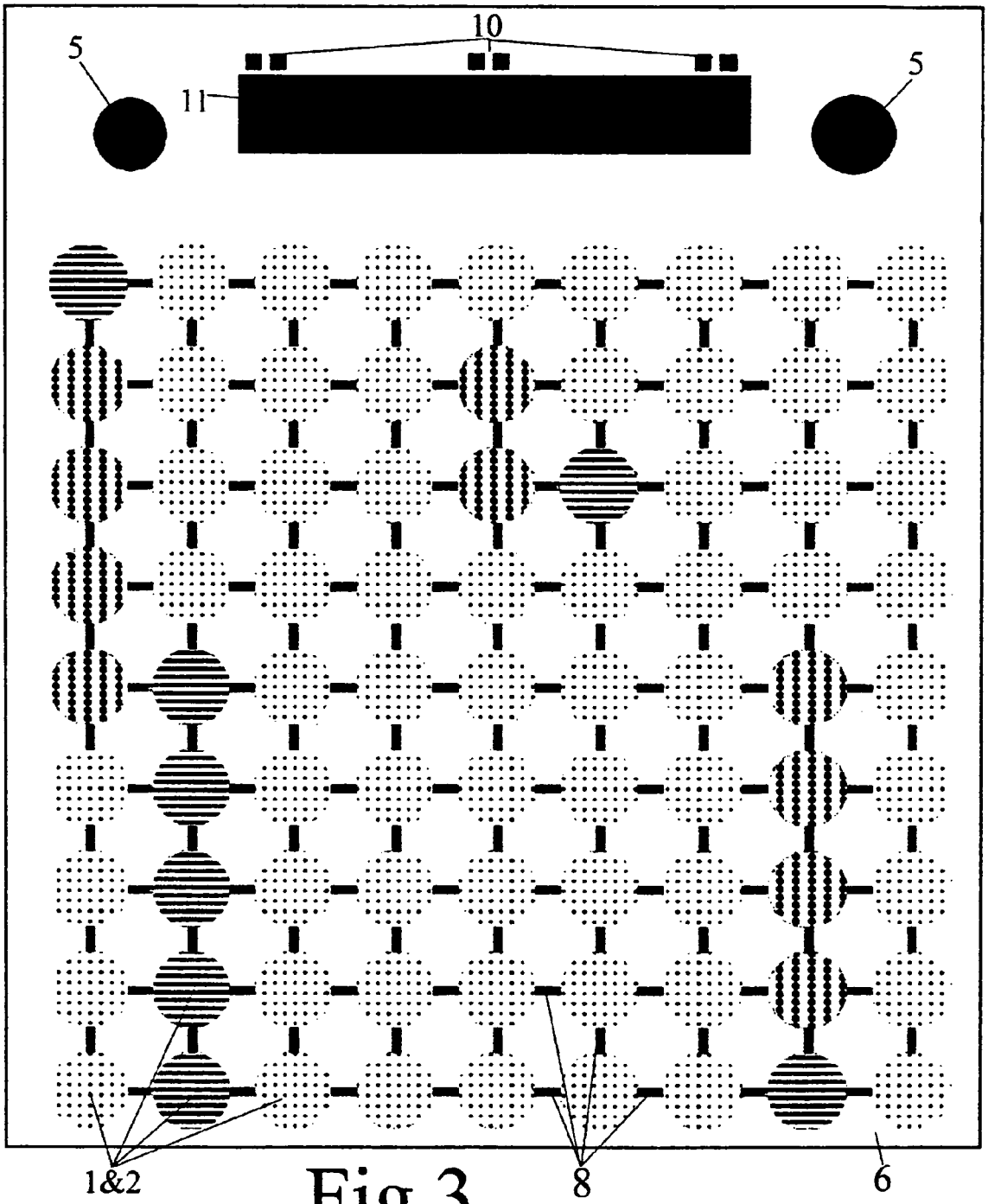
FIG. 3 is a sketch of the way the board looks for players from above.

FIG. 3 shows a sketch of the board from above in a middle of a game, with some grid points illuminated. Most of the grid points are not illuminated (circles with points). Some of the points are illuminated in one of two colours (indicated in the figure by two different shading). Because the buttons are translucent (rather than transparent), the LEDs 2 are not actually visible.

The embodiment of the grid points which is described above seems to be the most effective with current technology, but some parts can easily be changed if and when other technologies improve or new technologies become available, without affecting the overall design of the board. The detection of pressing a grid point may be done by any discrete input device, for example standard contact switch and capacitive switch. The illumination of the grid points can be done by other kind of sources, for example gas-discharge lamps and incandescent lamps.

In the embodiment which was described above the players press the grid points with their fingers. This is very convenient, which is one of the advantages of the board. However, it has a problem that the board cannot distinguish which player is pressing a point, so the players can press a point out of their turn. The possible solutions to this problem seem to be too cumbersome and in some cases too expensive, so they are not included in the preferred embodiment. However, some of the solutions may prove to be convenient and cheap enough to be acceptable, and if the board is used for formal tournaments it may become an essential requirement.

A cheap and simple solution is to add two buttons on two sides of the board, one for each player, and the player will need to either hold down his own button while pressing a point or to first press his button and then press the point.

Another solution is to have two probes connected to the board, and the players use them to press the points. The contact between the probe and the board creates a short circuit which the board detects and hence can tell which probe, and hence which player, presses the point. An advantage of this solution is that it means that the sensor in each grid point can be a simple conducting element, instead of the membrane keyboard which is described above, which may make the board actually cheaper. Alternatively this method can be used to detect which player presses a point, in combination with another method to detect which point is pressed. For example, a membrane keyboard can be coated with a conducting layer, and the short circuit is caused when the probe touches this layer. In this case the membrane keyboard will detect which point is pressed, and the short circuit detects which player presses it.

Another variation of this solution is that the board emits some signal (electromagnetic or maybe ultrasound), and the probe detects this signal, and the probe that detects the signal more strongly is the one that actually presses. In this case the probe does not need to touch the board, so may be worn by the players, rather than held, which is more convenient. Another variation is that the probe interferes with or reflects the signal, and the board uses this response to detect which player presses the board, in this case, the probe does not need to be connected to the board. Alternatively, the probes themselves may emit different signals.

The solution above requires the players to hold or wear an object, which is uncomfortable. A possible solution is to mark the fingers of the players, by some material that adhere to the skin, and that the board can detect. Even more advanced technology may be able to recognise the fingers of the players directly.

The Software:

The central loop of the software repeats these four steps:

1) Check if any of the control buttons was pressed. If any control button was pressed, perform the appropriate operation (change the game, set a parameter, stop the game, start the game).
2) Check if any of the grid points was pressed. If so, compute the implications according to the rules of the current game, perform all the changes to the board, and then switch the turn to the other player. Switching the turn means switching the turn light of the current player off, setting the internal variable current_player to the other player, switching the turn light of the other player on and setting a variable, the turn end mark, to the current time plus the turn time.
3) Check the clock and compare it to various time marks. A time mark is a variable set to some value, which is compared to the current time. The most important is the turn end mark, and if this is passed, switch the turn as in 2. Other time marks are for updates of the displays.
4) Check if there are game specific operations to perform. If a player plays one of the two-players games against the board, this check perform the board's move.

Managing ClearIt:

The example board has these settable parameters for the game ClearIt:

1) number of points that should be switched on when the game starts. This default to 42.

2) Which affected points are switched off: of both colours, or only the player's colour, only of the opponent's colour. As described above, affected points that are not switched off change to the other colour. By default, all affected points are switched off.

3–4) Kind of pattern and Distance for the basic rule determining which points of the player's colour are affected.

5–6) Kind of pattern and Distance for the basic rule determining which points of the opponent's colour are affected.

Figure 4:
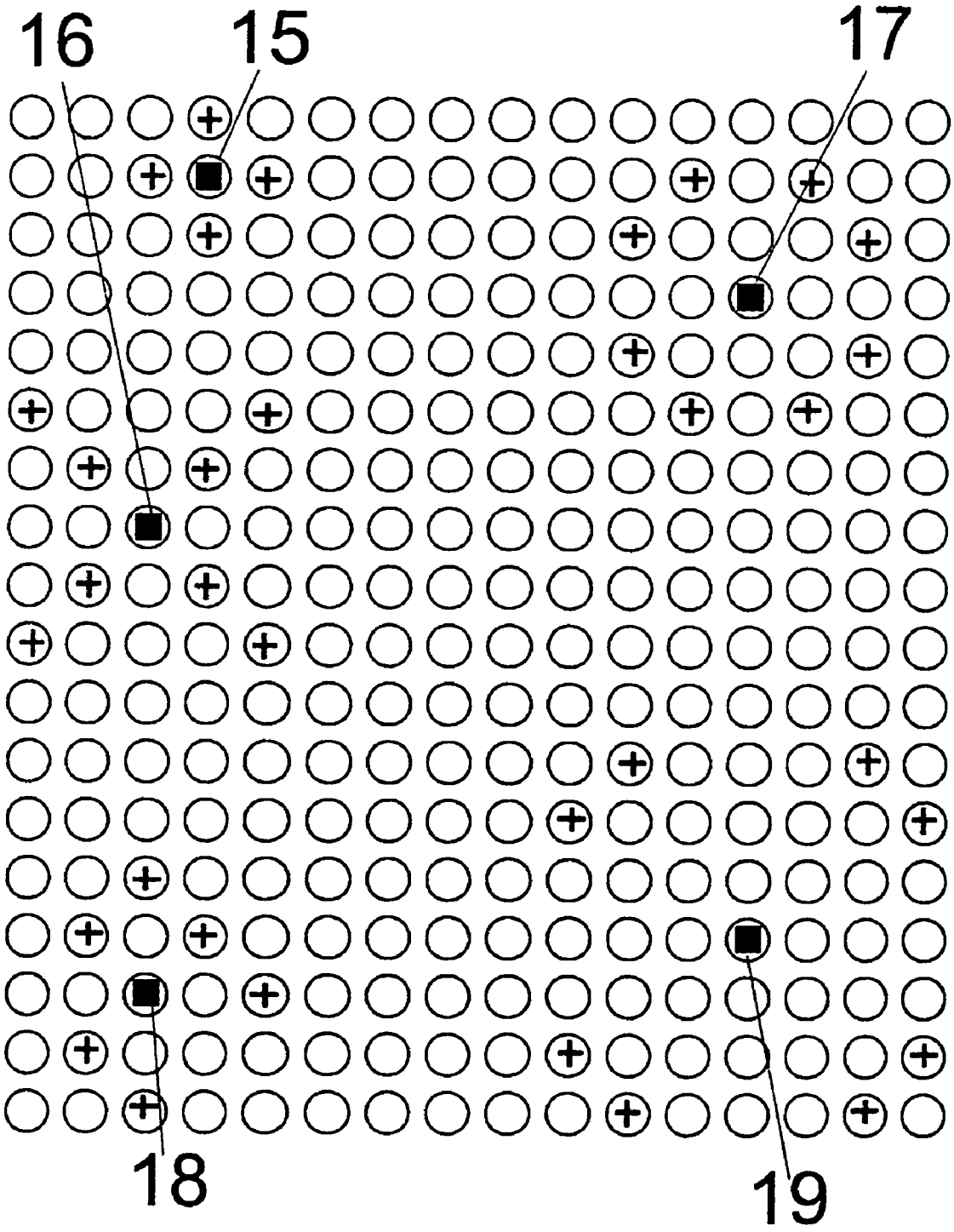
FIG. 4 shows some of the patterns that can be used in the game.
Figure 5:
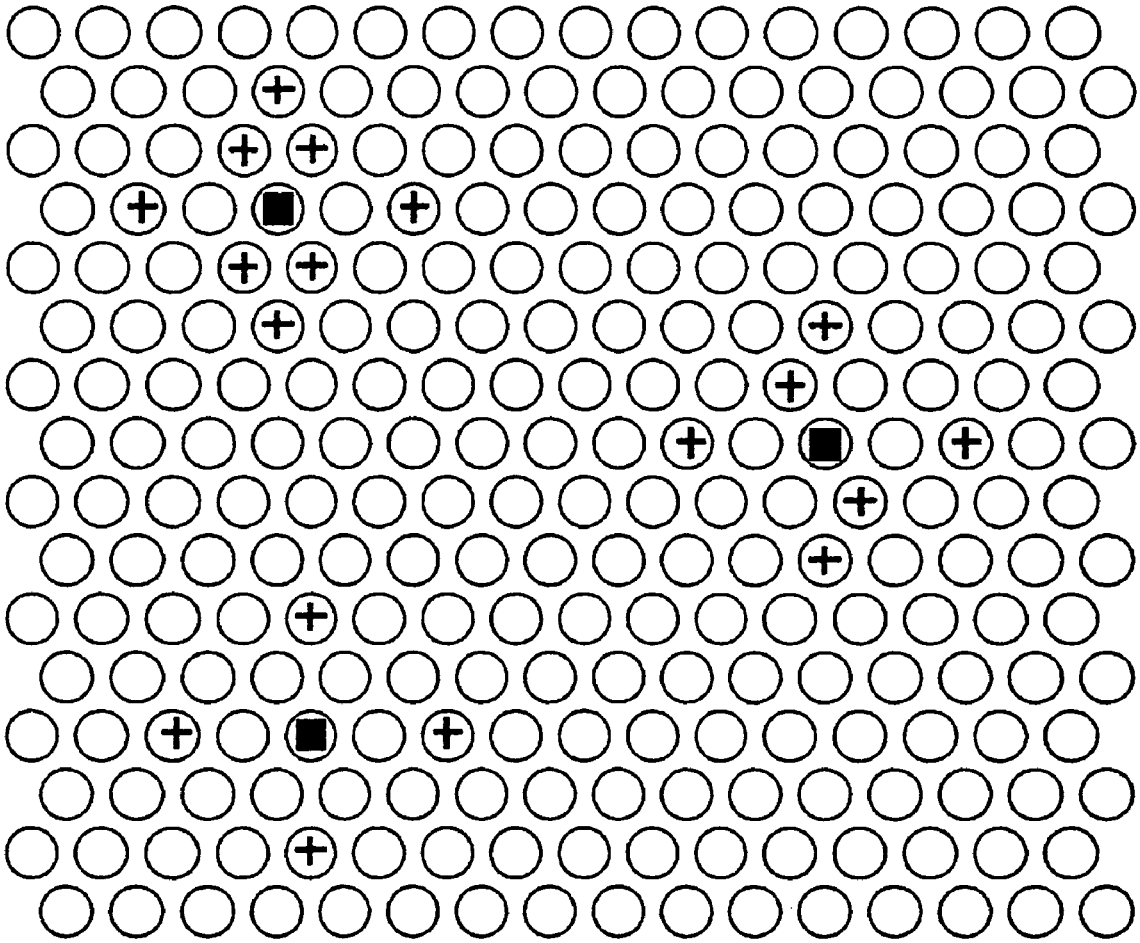
FIG. 5 shows alternative hexagonal arrangement of the points in the grid.

The Kind of pattern can be one of: Plus, Plus_X, X, X_X, Knight. When the Kind is Plus, points that are on the same row or the same column as the point that the player pressed and are within the range specified by the Distance parameter from the pressed point are affected. For example, Kind Plus and Distance 1 gives the pattern 15 in FIG. 4. Similarly, the Kind X specifies that points on the diagonals from the pressed point and in the range Distance are affected, e.g. Kind X and Distance 2 gives pattern 16. Kinds Plus_X and X_X are the same as Plus and X respectively, but only the points that are exactly Distance points away from the pressed point are affected. Kind Knight specifies that the affected points are the points that can be reached from the pressed point by moving Distance points along a row or a column, and then moving Distance −1 points in an orthogonal direction.

By default, the Kind both for colours is set to Knight, and the Distance 2 for the opponent's colour and 3 for the player's colour. This gives a rule that points that are affected when a player presses a point are points of the opponent's colour that can be reached by moving from the pressed point two points along the row or the column it is in and then moving one point in the orthogonal direction (Pattern 17 in FIG. 4), and points of the player's colour that can be reached by moving three points along the row or the column and then two points in the orthogonal direction (pattern 19). With the default setting of parameter (2), all of these points are switched off.

When the game starts, the games manager first uses the parameters 3–6 to create two list of pairs of numbers, one list for the player's colour (based on parameters 3–4) and one for the opponent's colour (parameters 5–6). Each pair corresponds to a point in the pattern, and specifies the offset along the row and along the column of the affected point from the pressed point. For example, for pattern 15 the list is {{1 0} {0 1} {0 −1} {−1 0}}, and for pattern 17 it is {{2 1} {1 2} {−1 2} {2 −1} {1 −2} {−2 1} {−1 −2} {−2 −1}}. When a player presses a point, the games manager scans the list of pairs for the player's colour. For each pair, it adds the first number to the line of the pressed point and the second number to the column, to get a pair of line and column. Then it checks if the new pair of numbers specifies a point inside the grid and if the point is illuminated by the player's colour. If it is, it switches it off or change it to the opponent's colour, depending on the setting of parameter (2). If parameter (2) is set such that points of the opponent's colour change colour rather than switched off, and no point was switched off at this stage, the games manager rejects the move as illegal and restore any changes. It then repeats the same with the other list, except that it now checks that the affected point is of the opponent's colour.

The method of selecting the rule that was describe above allows the players to select quite wide range of patterns, which are symmetrical and easy to remember. The range can be extended by adding Kinds, which may include asymmetrical ones. In addition, the board may allow the players to specify a pattern explicitly, by letting the players pressing some points, and then defining a pattern that will cause these points to be affected when the central point of the board is pressed.

The invention claimed is:

1. An electronic board comprising a grid of grid points on a flat surface, where each grid point is a visible element which is capable of detecting when it is pressed, and an illumination source inside or below the surface which is capable illuminating the visible element by either of two colours, which exhibits a behaviour which makes it useful for playing various games;

and in one of these games the behaviour of the board is as follows;

the game starts with an equal number of points illuminated in each of the two colours;

the board remembers two fixed patterns of points with respect to the point that is pressed, which will be referred to as the current player pattern and the opponent player pattern;

the board keeps a record of one of the colours above as the current player colour;

when a point is pressed, the board switches off points in the current player colour that are in the current player pattern with respect to the pressed point and points in the other colour that are in the opponent player pattern with respect to the pressed point, and then makes the other colour the current player colour;

when all the points that are illuminated are illuminated in the same colour, the board declares the player of this colour as winner.

2. A board as described in claim 1, where the arrangement of the points is square, and when a point is pressed the board switches off points of the current player colour which can be reached from the pressed point by moving three point along the line or the column that the pressed point is in and then moving two points in orthogonal direction, and points of the other colour which can be reached from the pressed point by moving two points along the said row or the said column and then moving one point in an orthogonal direction.

* * * * *